United States Patent [19]

Honda et al.

[11] 3,970,383

[45] July 20, 1976

[54] APPARATUS FOR COLOR ELECTROPHOTOGRAPHY

[75] Inventors: Saburo Honda, Tokyo; Kyoji Kunitomo, Koganei; Yasumori Nagahara, Yokosuka, all of Japan

[73] Assignee: Ricoh Co., Ltd., Tokyo, Japan

[22] Filed: Nov. 14, 1974

[21] Appl. No.: 523,842

[30] Foreign Application Priority Data

Nov. 15, 1973 Japan ..... 48-128641

[52] U.S. Cl. ..... 355/4; 355/8

[51] Int. Cl.[2] ..... G03G 15/01; G03G 15/30

[58] Field of Search ..... 355/4, 8; 96/1.2

[56] References Cited

UNITED STATES PATENTS

| | | | |
|---|---|---|---|
| 2,986,466 | 5/1961 | Kaprelian | 355/4 X |
| 3,115,814 | 12/1963 | Kaprelian | 96/1.4 X |
| 3,771,866 | 11/1973 | Ogawa | 355/3 R |
| 3,871,879 | 3/1975 | Arai | 96/1.2 |

*Primary Examiner*—L. T. Hix
*Assistant Examiner*—Kenneth C. Hutchison
*Attorney, Agent, or Firm*—Cooper, Dunham, Clark, Griffin & Moran

[57] ABSTRACT

An apparatus for color electrophotography including optical scanning means which moves intermediate a stationary original document and a copy sheet for scanning the colored image on the document onto, and a drum-shaped photoreceptor which is rotated in synchronism with the scanning movement of said scanning means. Successive images are scanned through different color filters to form successive electrostatic latent images thereon which are successively transferred from the rotating photoreceptor onto a stationary copy sheet. Each electrostatic image is successively developed using developer of a color corresponding to that of the filter used during the preceding scan before the following scan.

4 Claims, 7 Drawing Figures

APPARATUS FOR COLOR ELECTROPHOTOGRAPHY

BACKGROUND OF THE INVENTION

The invention relates to an apparatus for colour electrophotography, and more particularly to such apparatus which performs the steps of charging, exposure and transfer of an electrostatic latent image formed while maintaining both an original and a copy sheet stationary.

In colour electrophotography, a colour image is obtained by successively forming a number of visual images of different colours corresponding to different filters used in the process of colour separation of the image of the original, which colour image is formed on a copy sheet in a superimposed manner. As a specific transfer means for such colour electrophotography, a photosensitive member having a layer of photoconductive material may be used to form visual images by repeating the steps of charging, exposure and developing. Alternatively, a visual image may be transferred onto another sheet, but this involves the possibility that the response of the layer of photoconductive material may be impeded, since an electrostatic latent image must be formed during these cycles by the steps of charging and exposing the photosensitive member which carries a visual image thereon. The compensation of this required the provision of various special means. In addition, the transfer of a visual image cannot be expected to be perfect since it is a transfer of a tangible material.

On the other hand, a drum is customarily used as a photosensitive member in the art of colour electrophotography and is rotated at a determined position during the steps of charging, exposure and developing. In this instance, the exposure optical system must be capable of moving back and forth in correspondence to the rotation of the photosensitive member, which resulted in a complicate construction and control of the apparatus as well as a reduction in the copying efficiency.

SUMMARY OF THE INVENTION

The present invention provides an apparatus for colour electrophotography which completely eliminates the above-mentioned inconveniences in the prior art colour electrophotography, by causing a photosensitive drum to roll over a copy sheet together with a commensurate movement of a charger, a slitwise exposure optical system, and if required a developing unit, thereby transferring an electrostatic latent image formed on the photosensitive drum onto the copy sheet which is then developed.

In accordance with the invention, at least a charger and an exposure unit are disposed alongside a photosensitive drum so that the steps of charging, exposure and transfer of an electrostatic latent image are accomplished in one step during rolling movement of the photosensitive drum located intermediate an original and a copy sheet. There is no need for a special control of the interrelationship between a slitwise exposure optical system and the photosensitive drum, thereby simplifying the construction of the apparatus and substantially improving the copying efficiency. In contradistinction to a transfer of a visual image, an electrostatic latent image is transferred in accordance with the invention, with a consequence that the transfer takes place reliably and with good quality. Because the transfer is made not onto a photosensitive member but onto a dielectric, a visual image may be formed on the latter without any adverse influence upon the formation of the next latent image.

DETAILED DESCRIPTION OF EMBODIMENTS

Figure 1:
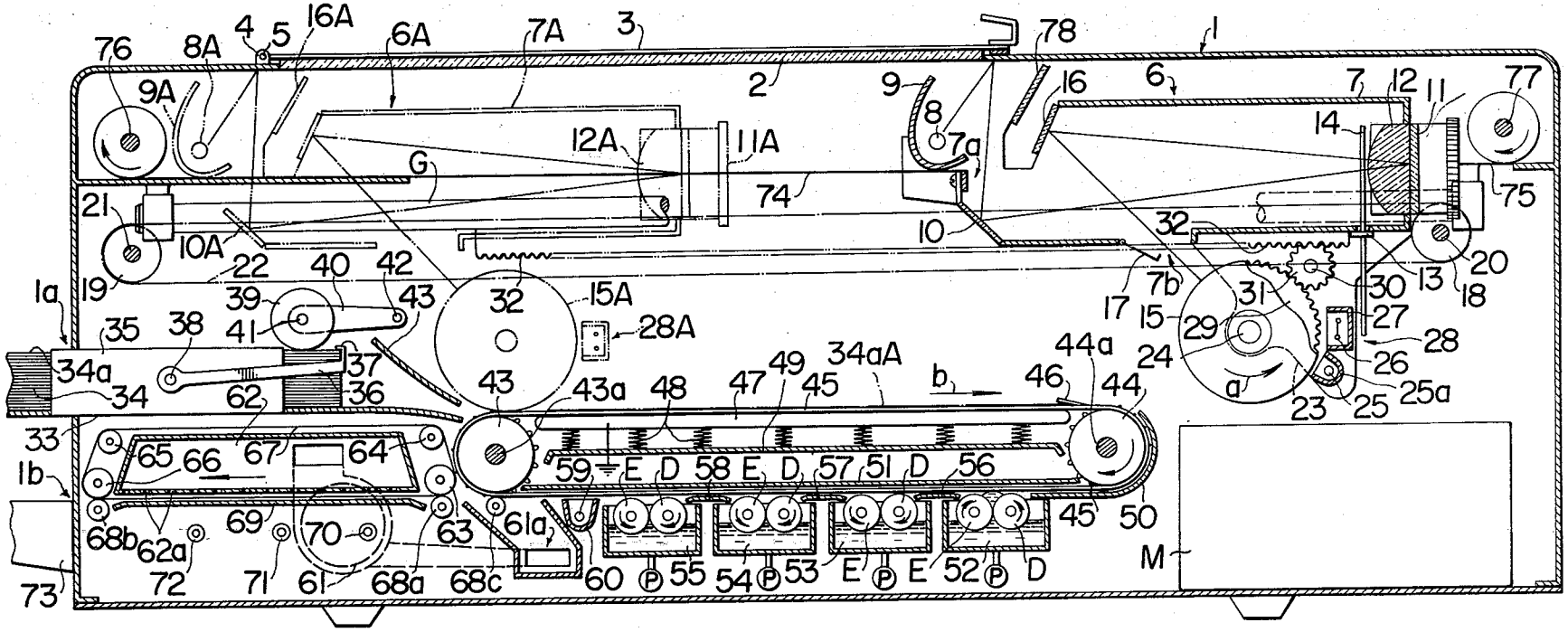
FIG. 1 is a vertical cross section of the apparatus for colour electrophotography constructed in accordance with one embodiment of the invention.

Throughout the drawings, parts performing similar functions are designated by like reference numerals or characters. FIG. 1 shows an apparatus according to the invention which is constructed so that the steps of charging, exposure and transfer of a latent image are effected during the forward stroke of a photosensitive drum, and subsequently the electrostatic latent image transferred onto a copy sheet is developed. The apparatus includes a casing 1 having a window formed in its top portion in which an original receptacle 2 of a transparent material such as glass is fixedly mounted. An original retainer 3 formed of rubber is disposed on the receptacle so as to be removable therefrom by pivotally connecting a pin 5 fixed to one end thereof in a hinge 4 is secured to the casing 1. The other end of the retainer 3 remains free, so that it can be removed from the receptacle 1 to insert a colour original thereon, and subsequently the original is held in place by the retainer 3.

A slitwise exposure optical system 6 is shown in the righthand and upper portion of FIG. 1, and includes a frame 7 which is slidably supported within the casing 1 by a horizontally extending guide rod G. The slitwise exposure optical system may be of a conventional design, and may comprise, for example, a light source 8 for illuminating the original, a reflector 9 disposed on the back of the light source 8, a reflecting mirror 10 for scanning the original which is being illuminated by light from the source 8, a projection lens 12 associated with a rearwardly disposed reflecting mirror 11 for projecting the light from the reflecting mirror 10, a colour separation filter assembly 14 disposed in the light path forwardly of the projection lens 12 and rotatably mounted on a shaft 13 which is journaled on the frame 7, a reflecting mirror 16 for reflecting the light emitted forwardly from the projection lens 12 toward a photosensitive drum 15, and a diaphragm 17 which is rockably mounted on the frame 7. It should be understood that portions of the top and bottom surfaces of the frame 7 which lie in the path of projection light are apertured to form windows 7*a*, 7*b*. A pair of pulleys 18, 19 are rotatably mounted on axles 20, 21 on the lateral sides of the casing 1, and a wire 22 extending around these pulleys 18, 19 extends between a drive source, not shown, and another pulley, not shown, mounted on the frame 7 of the slitwise exposure optical system.

However, any suitable alternative drive system may be used.

A support plate 23 is secured to the frame 7 and carries a shaft 24 on which the photosensitive drum 15 is rotatably mounted. The photosensitive drum 15 may comprise a support drum formed of aluminium, copper or the like, and a photosensitive layer deposited on the peripheral surface thereof and including photoconductive material such as selenium, zinc oxide or poly-N-vinylcarbazole. Fixedly mounted on the support plate 23 at a position opposite to the peripheral surface of the photosensitive drum 15 are a quenching lamp 25 associated with a reflector 25*a*, and a wire electrode 26 surrounded by a shield 27, the electrode 26 serving a corona discharge and forming a charger 28. A gear 29 of a large diameter is fixedly mounted on the shaft 24 of the photosensitive drum 15, and meshes with a pinion 31 which is rotatably mounted on an axle 30 that is in turn mounted on the support plate 23. A rack 32 is fixedly mounted within the casing 1 and extends in a direction parallel to the guide rod G, the rack 32 meshing with the pinion 31.

As shown in the left-hand and bottom portion of FIG. 1, a copy sheet receptacle 33 is provided within the casing 1 and extends through an opening 1*a* formed therein. A stack of copy sheets 34, cut to size, are disposed on the receptacle 33, and sideplates 35 laterally align these copy sheets. The copy sheet 34 comprises a layer of dielectric material such as a copolymer of vinyl chloride and vinyl acetate disposed on a support such as a conductive paper, for example. An arm 36 formed with a sheet scraper pawl 37 at its free end is rotatably mounted at its other end on the sideplate 35, and the pawl 37 bears against the forward end or the right-hand end, as viewed in FIG. 1, of the copy sheets 34 disposed on the receptacle 33 on account of its own weight. The forward portion of the sheet 34 is also contacted by a sheet feed roller 39 which bears thereagainst by its own weight. The roller 39 is rotatably mounted on a pivot 41 which is carried by the free end of a support arm 40, the other end of which is rotatably mounted by pivot 42 on the inner wall of the casing 1. A guide plate 43' is disposed forwardly of the receptacle 33 and at a position raised with respect thereto. At a position forwardly of the guide plate 43', a pair of belt rollers 43, 44 are mounted on shafts 43*a*, 44*a* which are journaled on the casing 1, and an endless belt 45 is disposed around these rollers. The belt 45 has perforations therein which engage sprockets on the rollers 43, 44. At one location along its outer surface, the belt 45 is provided with a clamp 46 which is adapted to engage with a leading edge of a copy sheet.

Below the upper run of the endless belt 45, an electrically conductive urging plate 47 is mounted on a stationary plate 49 with a plurality of springs 48 interposed therebetween. The urging plate 47 is urged by these springs 48 to bear against the upper run of the endless belt 45, assuring an adequate degree of planarity to such run. A guide plate 50 is disposed adjacent to the right-hand bend of the belt 45 for guiding a copy sheet 34*a* mounted thereon as it moves around the roller 44.

An abutment plate 51 is fixedly mounted inside the lower run of the endless belt 45, below which a plurality of vessels for containing developing solutions corresponding to the colour separation filters 14 are disposed in an appropriate sequence, as viewed in the direction in which the belt 45 runs. In each vessel, a pair of closely located developing rollers D, E are rotatably mounted, with their peripheral surfaces partially immersed into the developing solution in the vessel. These rollers are driven for rotation by a suitable drive unit. When the rollers D, E rotate in the directions indicated by respective arrows, that is, when the roller D rotates counterclockwise while the roller E rotates clockwise, the developing solution will be raised into contact with a copy sheet. Conversely, when the rollers D, E rotate in the opposite directions, the developing solution will not be raised, but only stirred. Guide plates 56, 57 and 58 are fixedly located between adjacent vessels to prevent the trailing end of the copy sheet from falling down.

To the left of the vessel 55, as viewed in FIG. 1, there is disposed a quenching lamp 59 with its associated reflector 60 so as to be opposite to the endless belt 45. A blower 61 has its air exhaust 61*a* opening at a position below the roller 43 for supplying a dry air to the copy sheet which has been subjected to the developing step. A suction box 62 is disposed to the left of the roller 43, as viewed in FIG. 1, and at a position below the receptacle 33, and an endless belt 67 extends around belt rollers 63, 64, 65 and 66 which are disposed around the suction box 62. Belt rollers 63 and 66 are engaged by rollers 68*a* and 68*b*, across which extends a guide plate 69. Heaters 70, 71 and 72 used for fixing the developed image are fixedly disposed below the guide plate 69. The bottom wall of the suction box 62 is formed with a number of small apertures 62*a* for attracting the copy sheet thereto, and the suction box is connected with the blower 61 to attract the copy sheet thereto by the operation of the blower 61. A discharge port 1*b* is formed in the wall of the casing 1 at a position to the left of the rollers 66 and 68*b*, and a copy discharge table 73 is fixedly mounted on the casing 1 at a position outside the discharge port 1*b*.

At the longitudinal ends and in the top portion of the casing 1, a pair of light shield screens 74, 75 are disposed in roll form on winding shafts 76, 77, respectively and have their other ends secured to the frame 7 of the slitwise exposure optical system 6. The winding shafts 76, 77 are resiliently biased to reel off the respective screens 74, 75 as they are driven by a movement of the optical system 6, thereby preventing stray light from the light source 8 from entering the region of the photosensitive drum 15. A reflecting mirror 78 is disposed adjacent to the window 7*a* in the frame 7 at a position opposite to the light source 8 for preventing the generation of stray light. Reference character M represents a drive source.

The apparatus shown in FIG. 1 operates as follows: When a main switch, not shown, of the apparatus is closed, the drive source M is set in operation, and pumps P connected with the vessels 52, 53, 54, 55 are operated to supply the developing solution into these vessels, and also the developing rollers D, E are rotated in directions in which they do not raise the developing solution. Additionally, the blower 61, as well as heaters 70, 71, 72 are also operated, and the endless belt 67 begins to run.

When a print switch, not shown, is depressed, the feed roller 39 undergoes one revolution to feed the uppermost one 34*a* of the copy sheets 34 onto the endless belt 45. At this time, the clamp 46 on the endless belt 45 is positioned adjacent to the roller 43, whereby it engages and clamps the leading edge of the fed copy sheet 34*a*. This clamping operation is detected by suitable means to start the rotation of the rollers 43, 44, whereby the endless belt 45 carries the clamped copy sheet 34*a* to an exposure position 34*a*A shown in FIG. 1, where its motion is interrupted.

When the copy sheet 34*a* is stopped at the exposure position, the light source 8, quenching lamp 25 and the charger 28 are energized, and the drive system for the slitwise exposure optical system 6 is operated. Thereupon the optical system 6 starts to move through its first forward stroke from its start position shown, to its left-hand terminal position 6A shown in phantom lines, thus scanning the original with its reflecting mirror 10. The frame 7, light source 8, reflectors 9 to 11 and 16, projection lens 12 in the terminal position are shown by phantom lines designated by 7A, 8A, 9A, 10A, 11A, 16A and 12A, respectively.

Concurrently with the forward stroke of the optical system 6, the photosensitive drum 15 which is integral therewith also moves through its forward stroke to a position 15A shown in phantom lines. During such movement, the gear 29 is rotated as a result of its meshing engagement with the pinion 31 which also rotates by its meshing engagement with the rack 32, whereby the photosensitive drum 15 is rotated in the direction indicated by an arrow *a* with a given number of revolutions. The terminal position of the charger 28 is indicated at 28A. As the photosensitive drum 15 moves while rotating, the scanning light from the original is projected onto the photosensitive layer thereon through the projection lens 12 and through the filter 14, thereby successively forming an electrostatic latent image thereon.

The colour separation filter assembly includes at least three colour separation filters, for example, a red light transmitting filter, a green light transmitting filter and a blue light transmitting filter, and a full colour transmitting filter as required. The shaft 13 may be driven by a suitable selection means to locate one of the filters within the path of projection light before the forward stroke of the optical system is initiated. Thus, when a red light transmitting filter is selected, an electrostatic latent image in accordance with the red light is formed on the photosensitive layer of the drum during the first rolling and translational movement thereof.

As an electrostatic latent image is formed thereon, the rolling and translating photosensitive drum 15 moves into contact with the surface of the copy sheet 34*a* which is held stationary on the endless belt 45, thus transferring its latent image onto the copy sheet 34*a*. During this process, the copy sheet 34*a* is connected to the ground through its conductive layer and the urging plate 47, or a bias voltage may be applied thereto by suitable means. It will be appreciated that the position in which the copy sheet 34*a* is held stationary is chosen so that a proper registration is accomplished between its leading edge and that of the electrostatic latent image of the photosensitive drum.

Upon completion of the first forward stroke of the optical system 6 and the photosensitive drum 15, the light source 8, the quenching lamp 25 and the charger 28 are deenergized, and the drive system therefor is intructed for a reverse motion, whereby the optical system 6 and the photosensitive drum 15 return to their initial position. When the first stroke of the optical system 6 and the photosensitive drum 15 is terminated in this manner, the rollers 43, 44 are controlled to rotate the belt 45 through exactly one revolution in the direction indicated by an arrow *b* while carrying the copy sheet 34*a* onto which the electrostatic latent image according to the red light has been transferred.

The vessels 52, 53, 54 and 55 contain developing solutions each including a cyan toner, a magenta toner, a yellow toner or a black toner corresponding to the red filter, green filter, blue filter and full colour filter, respectively. The developing rollers D, E within the respective vessels are controlled in a manner such that when the rollers 43, 44 are driven through one revolution of the belt, only those developing rollers which are disposed within the vessel containing the developing solution of a colour which corresponds to that of the filter being used in the scanning process will rotate in the direction to raise the developing solution.

Consequently, when the first developing process is terminated, the developing rollers D, E in the vessel 52 which contains the developing solution of a colour corresponding to the red light transmitting filter, namely, the developing solution containing a cyan toner, will raise the developing solution to present cyan developing solution to the copy sheet 34*a* carried on the endless belt 45 as it passes thereover, thus converting the electrostatic latent imate according to the red light into a visual toner image of cyan colour. Subsequent to the formation of such toner image, any residual potential on the copy sheet 34*a* is removed by the quenching lamp 59, and the copy sheet has its toner image dried by means of the blower 61.

The copy sheet 34*a* having the first toner image formed thereon is returned to its original position by the endless belt 45 which has rotated through one revolution, and is held in such position when the belt is stopped. When the copy sheet 34*a* has returned to its initial position, a second forward stroke of the optical system 6 and the photosensitive drum 15 is initiated in the same manner as in the first stroke except that the green light transmitting filter is now disposed within the path of the projection light. The series of copying operations is repeated in the manner as mentioned above. This, time, an electrostatic latent image formed by the light transmitted through the green light transmitting filter is transferred onto the copy sheet 34*a*, and the developing solution of a corresponding colour, that is, the developing solution containing magenta toner, will be supplied to the copy sheet 34*a* by means of the developing rollers D, E in the vessel 53, thus superimposing a magenta toner image on the previously formed cyan toner image.

The copy sheet 34*a* on which the first and second toner images are formed is subjected to another transfer process initiated by a third forward stroke of the optical system 6 and the photosensitive drum 15 in which the blue light transmitting filter is used, whereby an electrostatic latent image according to the blue light is formed thereon, which is developed by a supply of the developing solution containing a toner of a corresponding colour, namely, a yellow toner, by means of the developing rollers, D, E, thus superimposing a yellow toner image upon the cyan and magenta toner images.

A further electrostatic latent image is formed on the copy sheet 34*a* on which the first to third toner images are formed by a fourth forward stroke of the optical system 6 and photosensitive drum 15 using the full colour transmitting filter, and the developing solution containing black toner which adjusts the image tone is supplied thereto by the developing rollers D, E within the vessel 55, thereby superimposing an adjusting black toner image upon the cyan, magenta and yellow toner images. If desired, the latter image tone adjusting step may be eliminated, in which case, the full colour transmitting filter and the vessel 55 for containing the developing solution of black colour can be omitted. Alternatively, the copying step using the full colour transmitting filter can be replaced by a copying step in which no filter is used.

When the above copying steps are repeated to form a desired colour image on the copy sheet 34*a*, the clamp 46 is released during the final developing step as it reaches the position of the roller 43. When the clamp 46 is released, the leading edge of the copy sheet 34*a* is fed into the nip between the roller 68*a* and the endless belt 67 running around the roller 63. The transfer of the copy sheet 34*a* from the endless belt 45 onto the endless belt 67 is facilitated by the provision of the roller 68*c* which bears against the roller 43. When the copy sheet 34*a* is transferred onto the endless belt 67 in this manner, it is carried along the lower run of the endless belt 67 by suction from the suction box 62, and while it is being carried by the belt 67 which runs in the direction indicated by an arrow, the colour image is fixed by the heaters 70, 71 and 72, and is discharged onto the table 73 as a colour copy.

Figure 2:
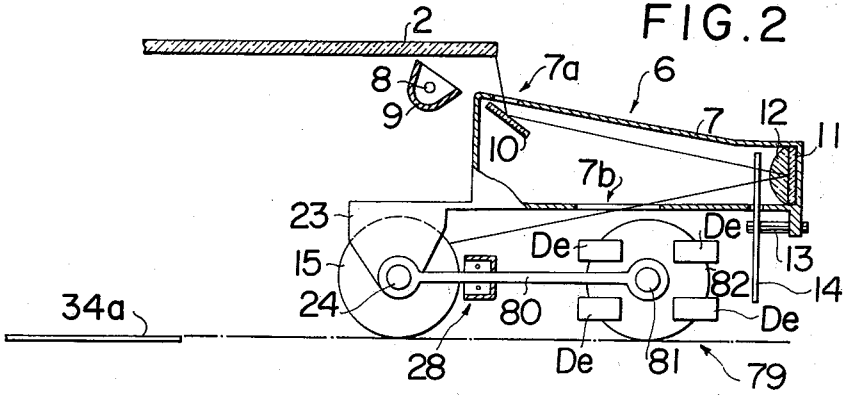
FIG. 2 is a schematic cross section of the apparatus for colour electrophotography according to another embodiment of the invention.

FIG. 2 shows an arrangement in which the slitwise exposure optical system 6, the photosensitive drum 15 and a developing unit 79 are translated integrally and their reciprocatory motion repeated by the number of colour separation filters used, to form a colour image on a stationary copy sheet 34*a*. Specifically, the support plate 23 integral with the frame 7 of the slitwise exposure optical system 6 carries the shaft 24 on which the photosensitive drum 15 is rotatably mounted, and an arbor 81 of the developing unit 79 is rotatably mounted on one end of a connecting rod 80 which has its other end lossely fitted on the shaft 24. The developing unit 79 is provided with four developing solution supply units De containing respective developing solutions of four colours as mentioned previously. These supply units De are mounted on a support disc 82 which is fixedly mounted on the arbor 81. A unit D*e* of a required colour can be made to cooperate with the copy sheet 34*a* in interlocked relationship with the switching of the filters, for example. In this manner, the steps of scanning the original, forming an electrostatic latent image on the photosensitive drum, transferring the latent image and developing a transferred latent image is achieved in a single and integral reciprocatory motion of the optical system 6, the photosensitive drum 15, and the developing unit 79, thereby forming a satisfactory colour image on the stationary copy sheet 34*a*.

Figure 3:
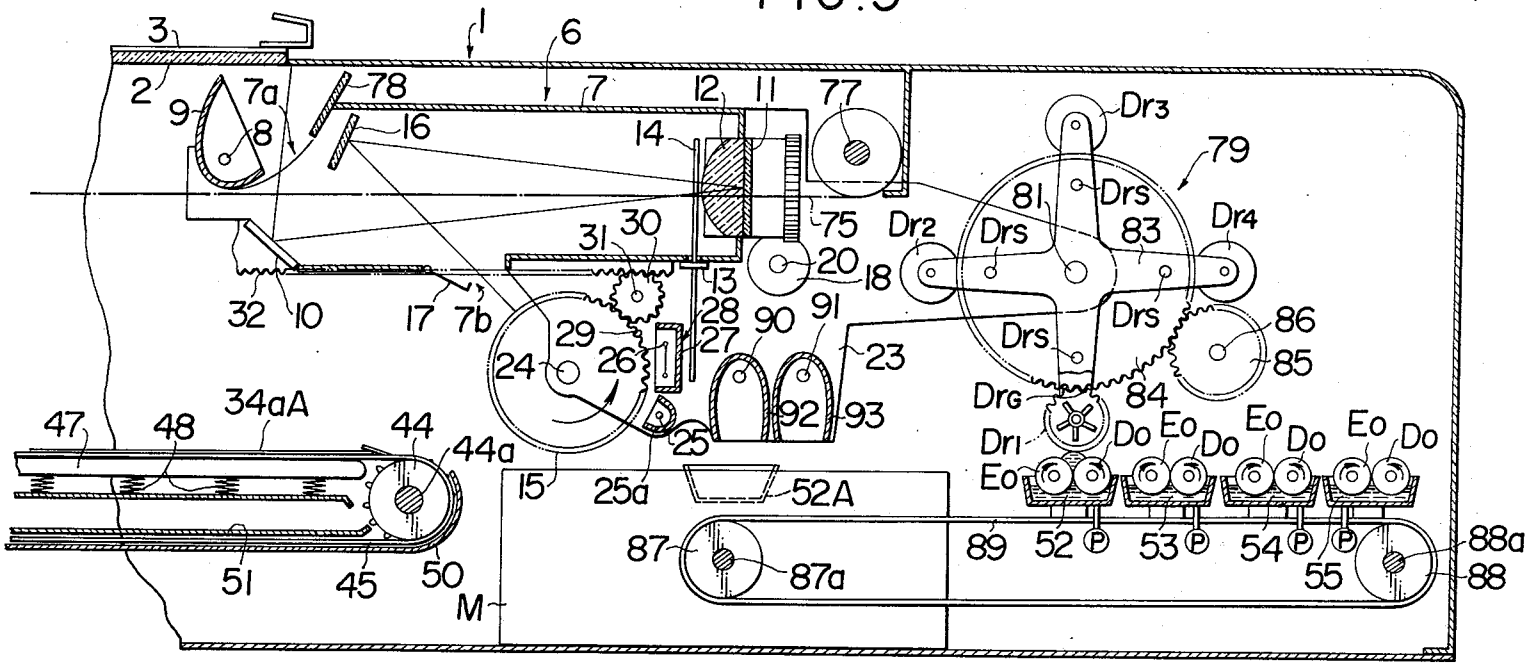
FIG. 3 is a fragmentary cross section of the apparatus for colour electrophotography according to a further embodiment of the invention.

FIG. 3 shows another arrangement in which applicator rollers D*r* are used as developing solution supply units D*e*. Specifically, referring to FIG. 3, the support plate 23 integral with the frame 7 of the slitwise exposure optical system 6 carries the photosensitive drum 15, quenching lamp 25 and the charger 28 as before, and additionally includes a right-hand extension which rotatably carries an arbor 81 for an arm member 83 of the developing unit 79. The arm member 83 has a number of arms which are equal to the number of the filters used, or four arms in the example shown, and applicator rollers D*r*1, D*r*2, D*r*3 and D*r*4 are rotatably mounted on the free ends of the respective arms. A large diameter gear 84 is rotatably mounted on the arbor 81 of the arm member 83, and meshes with a gear 85 for driving the applicator rollers. The gear 85 is mounted on an arbor 86 which is rotatably mounted in the wall of the casing 1, and is normally driven for rotation by the drive source M. As illustrated specifically with respect to the roller D*r*1, the respective applicator rollers D*r*1 to D*r*4 are integrally provided with a master gear D*r*G which meshes with the gear 84 for rotation. Each arm of the member 83 is provided with a pin D*r*S which may be moved by suitable means for selecting a particular applicator roller for cooperation with one of the developing solution vessels, 52, 53, 54 and 55. The rotation of the arm member 83 may be performed either automatically or manually, as by interlocked relationship with the selection of the filters, for example.

As in FIG. 1, the vessels 52, 53, 54 and 55 include a pair of developing solution supplying rollers $D_o$, $E_o$ in their interiors and are disposed along and secured to the upper run of an endless belt 89 running around a pair of belt rollers 87, 88 which are carried on a pair of shafts 87*a*, 88*a*. By rotating the rollers 87, 88 for a given angular interval, the endless belt 89 is caused to run to present a given vessel against a particular applicator roller for supplying the developing solution contained therein to the peripheral surface of this applicator roller. The selection of the vessels can also take place in interlocked relationship with the selection of the filters, for example.

When one of the applicator rollers D*r* is supplied with a developing solution of a colour corresponding to that of the filter selected, by means of the pair of rollers $D_o$, $E_o$, the optical system 6, the photosensitive drum 15 and the applicator roller D*r* are driven to start their forward stroke, whereby the photosensitive drum 15 rolls on the copy sheet 34*a* to transfer an electrostatic latent image thereon and subsequently the applicator roller rolls thereon to develop the latent image into a visual toner image. A quenching lamp 90 and a fixing heater 91 having respective reflectors 92, 93 associated therewith are provided on the support plate 23, and operate to process the toner image formed in a suitable manner during the reciprocatory motion of the optical system 6. In this embodiment, because the vessels containing the developing solutions are not disposed in opposing relationship with the lower run of the endless belt 45, the guide plate 50 is elongated to extend along the lower surface thereof. When the reciprocatory motion of the optical system 6, the photosensitive drum 15 and the applicator roller D*r* is repeated by a number of times which are equal in number to the filters used, the endless belt 45 undergoes one revolution, during which time the copy sheet 34*a* is finished to a colour copy and discharged.

Figure 4:
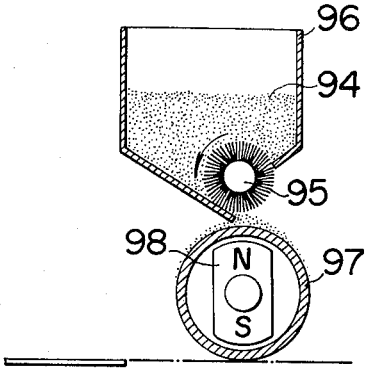
FIGS. 4 and 5 are cross sections illustrating examples of a developing unit.
Figure 5:
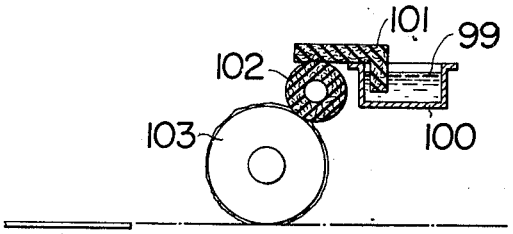

It should be understood that the slitwise exposure optical system, carrying or feeding means for the copy sheet or the means for supplying a developer to the copy sheet is not limited to the particular construction illustrated, but any other conventional means may be used as desired. The supply of a developer can take place by either the dry developing means shown in FIG. 4 or the wet developing means shown in FIG. 5. Specifically, in FIG. 4, a dry developer 94 comprising a toner and a carrier is contained within a funnel-like container 96 having a delivery brush roller 95 in its bottom, the brush roller 95 being driven in the direction indicated by an arrow to supply a suitable amount of the developer onto a cylinder 97. The cylinder 97 comprises a non-magnetic material and a magnet 98 is located within the cylinder. The relative rotation between the magnet and cylinder supplies the developer 94 existing on the peripheral surface to the copy sheet. Referring to FIG. 5, a developing solution 99 is contained within the vessel 100, and is pumped by a sponge-like capillary member 101 to a sponge roller 102, which applies it uniformly around the peripheral surface of a developing roller 103 for subsequent application onto the copy sheet.

Figure 6:
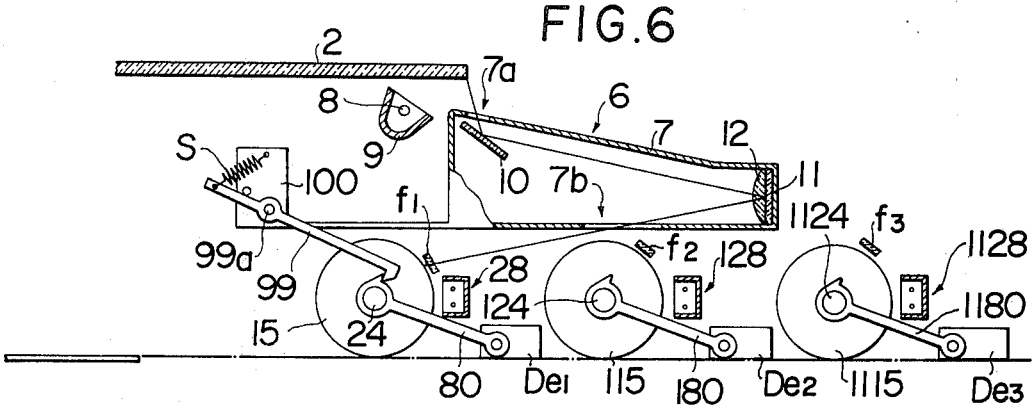
FIGS. 6 and 7 are schematic cross sections illustrating other embodiments of the invention.

FIG. 6 shows an arrangement of traction system in which the slitwise exposure optical system 6 is used in conjunction with three sets of the combination of the photosensitive drum and developing unit, each combination being provided for one of the three colour separation filters *f*1, *f*2 and *f*3. Specifically, photosensitive drums 15, 115, 1115 are each associated with a charger 28, 128, 1128 and a filter *f*1, *f*2, *f*3, respectively, and are connected with a developing unit D*e*1, D*e*2, D*e*3 of a corresponding colour through connecting rods 80, 180, 1180, respectively. The ends of the connecting rods 80, 180, 1180 which are on the photosensitive drums are formed as hooks which are engaged by a traction hook 99. The traction hook 99 is pivotally mounted at 99*a* on a support plate 100 which is integral with the frame 7 of the optical system 6, and is urged by a spring S to engage with the hooked end of each connecting rod.

After the slitwise exposure optical system 6, the photosensitive drum 15 and the developing unit D*e*1 have completed their forward stroke, the traction hook 99 is disengaged from the hooked end of the connecting rod 8, and only the optical system 6 returns together with traction hook 99, leaving the photosensitive drum 15 and its associated developing unit D*e*at the point where have reached when the forward stroke has terminated. When the optical system 6 has returned, the traction hook 99 engages the hooked end of the next connecting rod 180, thereby enabling the photosensitive drum 115 and the developing unit D*e*2 to be accompanied during the second forward stroke of the optical system 6. In this manner, a number of latent image transfer and developing steps corresponding to the three colour separation filters *f*1, *f*2, *f*3 are performed. It is to be noted that each of the filters is assembled so that it is positioned in the path of projection light relative to its associated photosensitive drum.

Figure 7:
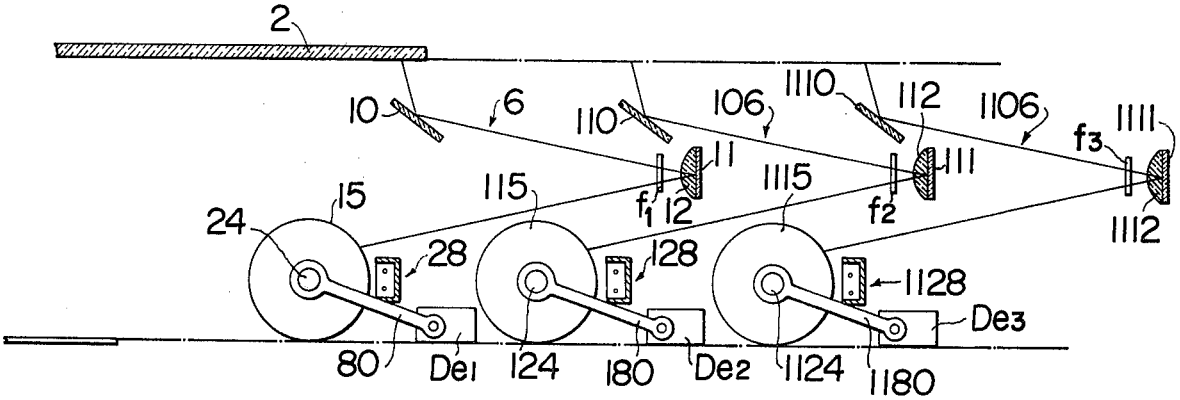

FIG. 7 shows an arrangement having a number of combinations of the slitwise exposure optical system, photosensitive drum and developing unit which are equal to the number of colour separation filters *f*1, *f*2, *f*3. Specifically, the filter *f*1 is associated with a slitwise exposure optical system 6 comprising a scanning reflecting mirror 10, projection lens 12 and reflecting mirror 11; a photosensitive drum 15 including a charger 28; and a developing unit D*e*1 connected therewith by connecting rod 80. Similarly, the filter *f*2 is associated with a slitwise exposure optical system 106 comprising a scanning reflecting mirror 110, projection lens 112 and reflecting mirror 111; a photosensitive drum 115 including a charger 128; and a developing unit D*e*2 connected therewith by connecting rod 180. Finally, the filter *f*3 is associated with a slitwise exposure optical system 1106 comprising a scanning reflecting mirror 1110, projection lens 1112 and reflecting mirror 1111; a photosensitive drum 1115 including a charger 1128; and a developing unit D*e*3 connected therewith by connecting rod 1180. With such an arrangement, it is possible to obtain a colour copy by a single forward stroke of the respective combinations. It should be understood that in the arrangements shown in FIGS. 6 and 7, the number of the filters can be freely varied, with a corresponding change in the number of developing units in the arrangement of FIG. 6 or with the corresponding change in the number of optical systems, photosensitive drums and developing units in the arrangement of FIG. 7.

What is claimed is:

1. An apparatus for colour electrophotography comprising:

movable optical scanning means for successively scanning a stationary original document by moving thereacross from one end to the other;

at least one drum-shaped photoreceptor means movable together with the scanning means and rotated in synchronism with its movement such that its peripheral surface is exposed to an optical image from the scanning means for forming an electrostatic image of said original document thereon;

a plurality of different colour filter means for successively filtering the optical image to said photoreceptor during successive scans;

means for holding a copy sheet stationary in the path of said rotating photoreceptor during each scan of the scanning means to permit each electrostatic latent image from the photoreceptor to be successively transferred thereto; and means for successively developing each latent image on the copy sheet with a developer of a colour corresponding to that of the filter used during the preceding scan.

2. An apparatus according to claim 1 in which the developing means is adapted to move together with the scanning means.

3. An apparatus according to claim 1 in which the number of photoreceptors is equal to the number of the filters used.

4. An apparatus according to claim 1 in which the number of scanning means is equal to the number of the filters used.

* * * * *